United States Patent [19]

Willis

[11] 4,241,840

[45] Dec. 30, 1980

[54] SAFETY CLOSURE ASSEMBLY WITH A SHEET METAL OVERCAP

[75] Inventor: Wilburn C. Willis, Hagerstown, Ind.

[73] Assignee: Aluminum Company of America, Pittsburgh, Pa.

[21] Appl. No.: 90,273

[22] Filed: Nov. 1, 1979

[51] Int. Cl.[3] ..... B65D 55/02

[52] U.S. Cl. ..... 215/220

[58] Field of Search ..... 215/220, 219

[56] References Cited

U.S. PATENT DOCUMENTS

| | | | |
|---|---|---|---|
| 3,097,756 | 7/1963 | Dorsey | 215/220 X |
| 3,638,819 | 2/1972 | Roy | 215/220 |
| 3,733,000 | 5/1973 | Scuderi | 215/220 |
| 3,924,770 | 12/1975 | Scuderi | 215/220 |
| 3,926,328 | 12/1975 | Cistone | 215/220 |
| 3,946,890 | 3/1976 | Scuderi | 215/220 |

*Primary Examiner*—G. T. Hall

*Attorney, Agent, or Firm*—David J. Hill

[57] ABSTRACT

A safety closure is disclosed for use with a container having a threaded neck. The closure includes an inner cap with a plurality of teeth on its top wall and internal threads for cooperatively engaging with the threaded neck of the container. The closure also includes a sheet metal overcap which overlies and is loosely mounted on the inner cap. The overcap has a plurality of louvers in its top wall which are adapted for cooperative engagement with the teeth of the inner cap. Each of the louvers of the overcap includes a flange portion which projects downwardly at an angle from the top wall of the overcap to a terminal edge defined by a slit in the top wall. An integral supporting arch portion connects each side of the flange portion to the top wall between the terminal edge and the junction of the flange portion and the top wall. A downwardly directed minimal force may be applied to the overcap while turning it in the closure-applying direction to engage the louvers of the overcap with the teeth of the inner cap and thereby screw the closure onto the container neck. A downwardly directed removing force must be applied to the overcap while turning it in the closure-removing direction to engage the louvers of the overcap with the teeth of the inner cap and thereby unscrew the closure from the container neck.

6 Claims, 7 Drawing Figures

SAFETY CLOSURE ASSEMBLY WITH A SHEET METAL OVERCAP

BACKGROUND OF THE INVENTION

The present invention relates to safety closures for containers such as those used to hold medicines, pesticides, poisons and other potentially harmful substances. More particularly, this invention relates to a two-piece safety closure assembly that is simple in construction, relatively inexpensive to manufacture, yet highly effective for its intended purpose.

A number of cases have been reported in recent years where small children have opened medicine bottles and the like and swallowed the contents, causing severe personal injury or death. Consequently, much effort has been expended to develop closures for these containers which cannot readily be opened by small children, but which, on the other hand, may be opened with relative ease by adults.

Many of the safety closures that have been developed for use on threaded containers have employed a pair of closure members that must be manipulated in some way so that they will cooperate in the opening of the closure. Some of these closures have required an intermeshing of sets of teeth on the closure members which are engaged by pushing the members together as the assembly is turned to remove it from the container. Such closures are disclosed in Scuderi's U.S. Pat. Nos. 3,733,000, 3,924,770 and 3,946,890. These closures are generally comprised of plastic members because of the relative ease with which teeth may be molded in plastic. It is possible to press or form teeth in a metal safety closure member, but the dimensional accuracy, precise definition and small size generally required for such teeth render such a process quite difficult and generally uneconomical.

There are certain advantages, however, which would inhere in a closure assembly having an outer member of sheet metal. Such an assembly could be made with a smaller diameter than an all-plastic assembly, because a plastic overcap would require a thicker skirt than a metal overcap in order to provide the requisite strength. A metal overcap also offers printing advantages over a similar overcap of plastic. Generally, plastic overcaps are printed, if at all, by a stamping method. This method is generally not appropriate for printing small characters of high legibility or for printing on a non-planar surface, such as the curved skirt of a generally cylindrical overcap. A metal overcap, on the other hand, may be printed before forming by offset lithography. This method allows small, precise characters to be printed on a planar metal blank before the blank is formed into a generally cylindrical overcap.

For the aforementioned reasons, it would be advantageous if a closure assembly employing a metal overcap and avoiding the problems inherent in providing teeth in such an overcap could be developed. One such assembly is described in U.S. Pat. No. 3,097,756 of Dorsey. As shown in FIGS. 17–30 of the Dorsey patent, a two-piece safety closure assembly may be provided with an inner cap having a series of ratchet teeth and an outer shell having a series of depending resilient tongues struck from the top wall of the shell. However, these structures are not alone sufficient to provide the safety feature of the closure, and a tool, such as a coin, must be employed to lock the inner cap and outer shell together in order that the closure may be removed from the container. Thus, although the closure assembly of Dorsey avoids the problem of providing teeth in a metal overcap, it requires the employment of a tool in order to remove the closure from the container.

An improved safety closure assembly having a metal overcap which avoids the problem of providing teeth of small dimensions in metal and which may be operated independent of any external tools is therefore desired.

SUMMARY OF THE INVENTION

It is an object of the present invention to provide a safety closure assembly which includes a metal overcap and which may be effectively used with a container having a threaded neck. It is a further object of this invention to provide such an assembly without requiring that small teeth of precise definition and high dimensional accuracy be formed in the metal overcap. It is another object of the invention to provide a safety closure which does not require the employment of an external tool to be operated. It is another object of the invention to provide a safety closure having a relatively small diameter. It is a further object of the invention to provide a safety closure having an overcap which may be printed with small characters of high legibility.

In accordance with these and other objects, the invention comprises a safety closure having an inner cap with a top wall and a depending skirt therearound, a plurality of teeth on the top wall and internal threads for cooperatively engaging with the threaded neck of a container, and a sheet metal overcap having a top wall with a depending skirt therearound and a plurality of louvers in the top wall. Each of these louvers includes a flange portion projecting downwardly at an angle from the top wall and terminating in a terminal edge which is defined by a slit in the top wall. Each louver also includes an integral supporting arch portion connecting each side of the flange portion to the top wall between the terminal edge and the junction of the flange portion and the top wall. The louvers are adapted for cooperative engagement with the teeth of the inner cap when the overcap is loosely mounted overlying the inner cap. The application of a downwardly directed minimal force to the overcap while turning it in the closure-applying direction will engage the terminal edges of the louvers of the overcap with the teeth of the inner cap and thereby screw the closure onto the container neck. The application of a downwardly directed removing force to the overcap while turning it in the closure-removing direction will cam the louvers of the overcap against the teeth of the inner cap and thereby unscrew the closure from the container neck. The application of downwardly directed force of less magnitude than the removing force while turning the overcap in the closure-removing direction will cause the louvers of the overcap to slide over the teeth of the inner cap, and will not result in the cooperative engagement of the overcap and inner cap that is necessary to impart a turning movement to the inner cap. Thus, the closure cannot be removed from a container unless a sufficient downwardly directed removing force is applied to the overcap while it is turned in the closure-removing direction.

In order to facilitate an understanding of the invention, its features are illustrated in the accompanying drawings and a detailed description thereof follows. It should be understood nevertheless that it is not intended that the invention be limited to the particular embodiment shown. Various changes and alterations are contemplated such as would ordinarily occur to one skilled in the art to which the invention relates.

DETAILED DESCRIPTION OF THE INVENTION

As used herein regarding a closure relative to a container, the term "downwardly" refers to a direction from the mouth to the bottom of the container. The term "inwardly" refers to a direction from the exterior to the interior of a container, closure or closure member. An "underside view" of a closure overcap is a view directed perpendicularly to the plane of the overcap's top wall which illustrates the surfaces of the overcap that are not visible when the overcap is viewed as part of a closure assembly on a container.

Figure 1:
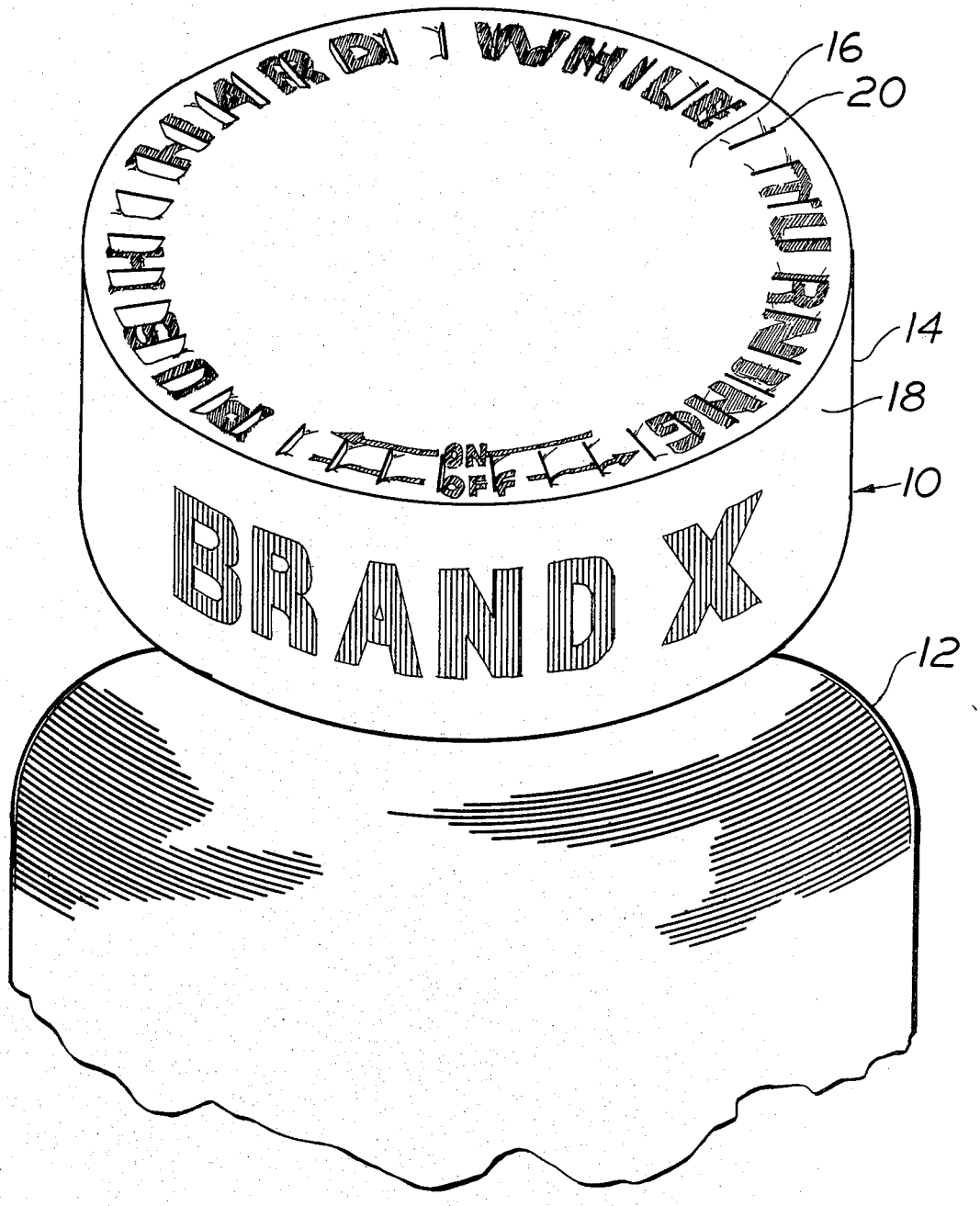
FIG. 1 is a perspective view of the safety closure of this invention, as applied to a container.
Figure 2:
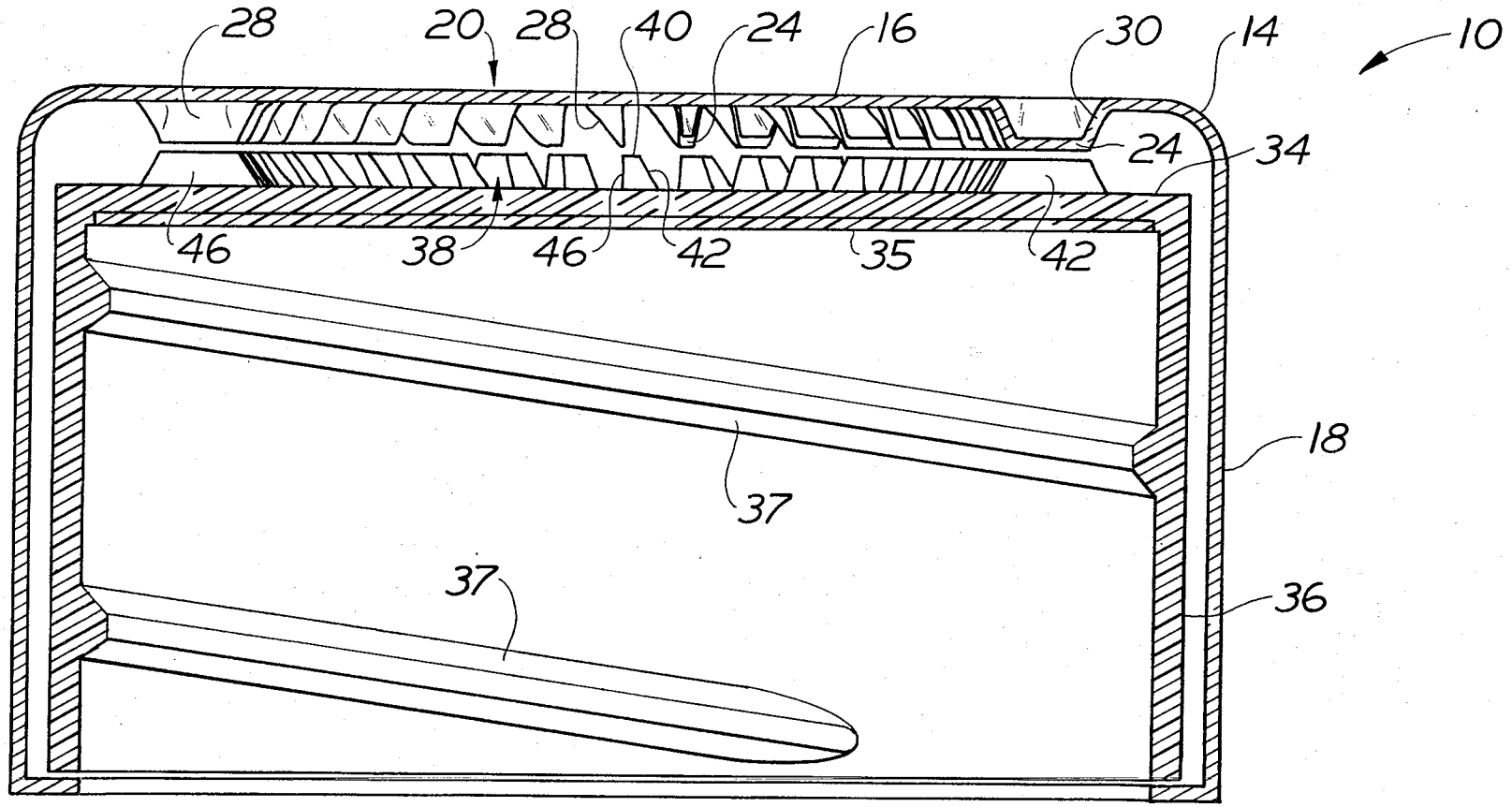
FIG. 2 is a cross-sectional view of the safety closure of FIG. 1.
Figure 3:
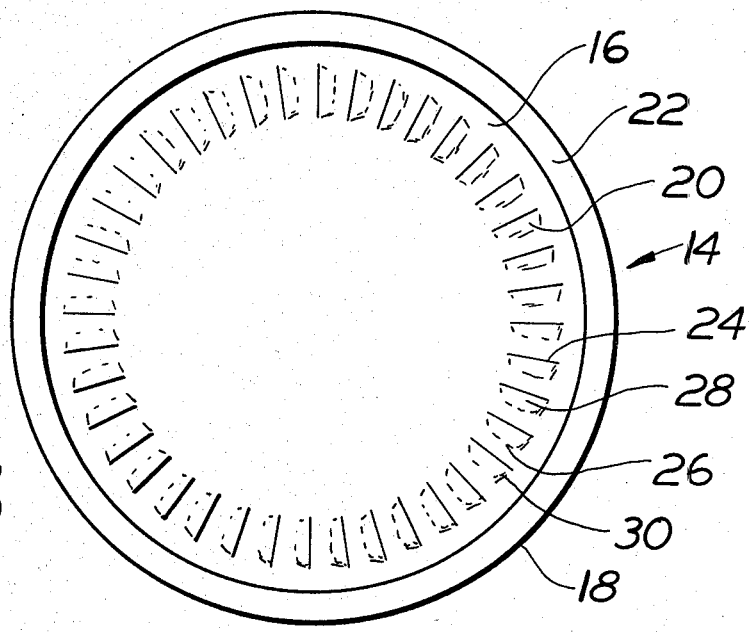
FIG. 3 is an elevation view of the underside of the closure overcap of this invention.
Figure 4:
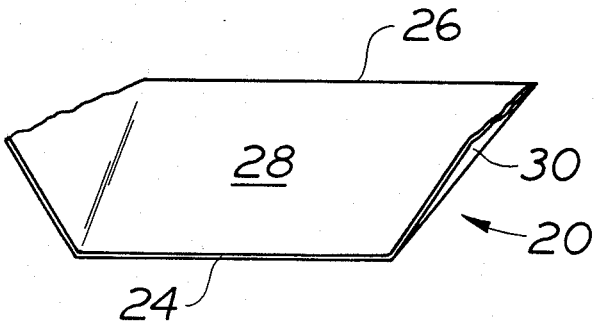
FIG. 4 is a perspective view of one of the louvers of the overcap of this invention.

Illustrated in FIGS. 1 and 2 is safety closure 10. This closure may be applied to a container such as container 12, which has a threaded neck and is representative of a common medicine bottle, as shown in FIG. 1. Closure 10 includes an overcap 14 of thin sheet metal. This overcap has a top wall 16 and a depending skirt 18 therearound. As shown in FIGS. 2 and 3, skirt 18 has a radially inwardly directed retaining rim 22 to hold inner cap 32 (see FIGS. 2 and 5) within the overcap. The top wall 16 of overcap 14 has a plurality of louvers 20 arranged preferably, as shown in FIGS. 1 and 3, in a circular configuration. A perspective view of one of these louvers 20 is shown in FIG. 4. Each louver includes a flange portion 28 which projects downwardly at an angle from top wall 16, and which terminates in a terminal edge 24 which is defined by slit 44 (see FIGS. 6 and 7) in the top wall. Each louver also includes integral supporting arch portions 30 which connect each side of flange portion 28 to top wall 16 between terminal edge 24 and the junction 26 of the flange portion and the top wall.

Figure 5:
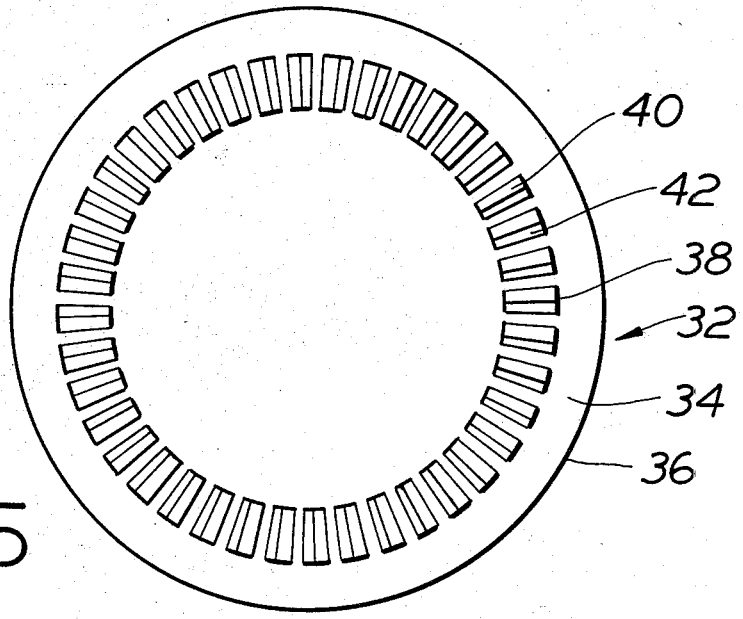
FIG. 5 is an elevation view of the top of the inner cap of this invention.

FIGS. 2 and 5 illustrate inner cap 32 of closure assembly 10. Cap 32 includes top wall 34 with a downwardly depending skirt 36 therearound. In addition, the cap preferably includes sealing liner 35 for sealing against the mouth of container 12 and internal threads 37 for cooperatively engaging against the threaded neck of the container. The top wall of cap 32 further includes a plurality of teeth 38, preferably arranged in a circular configuration. Cap 32 is adapted to be disposed within overcap 14 and retained therein by rim 22. Skirt 36 of inner cap 32 is somewhat shorter than skirt 18 of the overcap, so that limited axial displacement is possible between the inner cap and the overcap. Louvers 20 of overcap 14 are adapted for cooperative engagement with teeth 38 of inner cap 32. However, because of the loose mounting of the inner cap within the overcap, the overcap may be rotated freely with respect to the inner cap when the closure members are axially displaced from each other.

Figure 6:
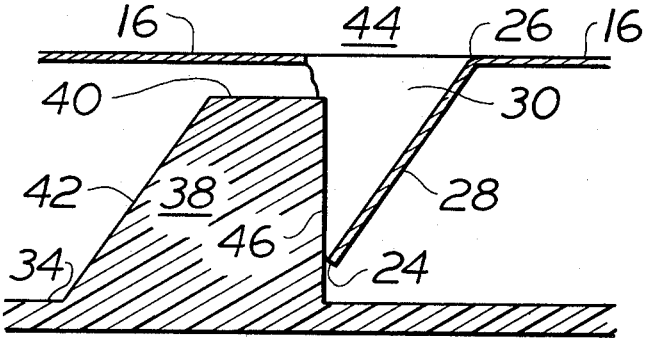
FIG. 6 is a cross-sectional view showing the engagement of a louver of the overcap with a tooth of the inner cap during rotation of the overcap in the closure-applying direction.

FIG. 6 illustrates the cooperative engagement between the louvers of the overcap with the teeth of the inner cap when a minimal force is applied downwardly to the overcap while turning it in the closure-applying direction. The force due to gravity acting on the overcap is sufficient to bring the louvers and teeth into the cooperative engagement illustrated in FIG. 6. When this minimal force is applied and the overcap turned in the closure-applying direction, terminal edges 24 of louvers 20 engage teeth 38 as shown in FIG. 6. Preferably, these teeth are generally trapezoidal in cross-section with the top surface 40 of each tooth being generally parallel to the plane of inner cap top wall 34. This trapezoidal shape provides strength to the teeth, and protects against shearing of the teeth by the louvers of the overcap. In the preferred embodiment illustrated in FIG. 6, side 46 of the tooth cross-section is generally perpendicular to the plane of top wall 34, and side 42 is inclined at an angle of about 55° to that plane. Because side 46 is generally perpendicular to the plane of top wall 34, terminal edge 24 of louver 20 may easily make the necessary engagement therewith upon application of a downwardly directed minimal force to screw the closure onto the container neck.

Figure 7:
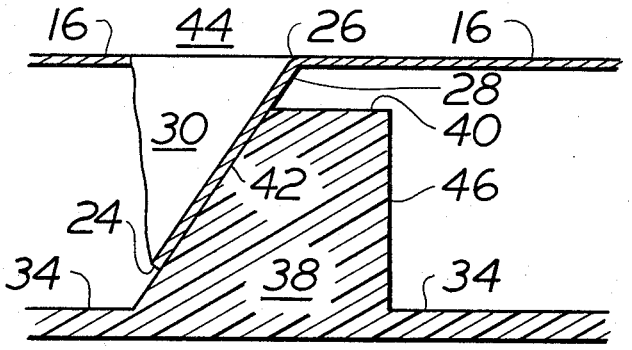
FIG. 7 is a cross-sectional view showing the engagement of a louver of the overcap with a tooth of the inner cap during rotation of the overcap in the closure-removing direction.

FIG. 7 illustrates the engagement of a louver of the overcap with a tooth of the inner cap during rotation of the overcap in the closure-removing direction. The application of a downwardly directed force to the overcap while turning it in the closure-removing direction will produce an effect which depends on the magnitude of the applied force. If the force is great enough, flange portions 28 of louvers 20 will be cammed against sides 42 of teeth 38 and the turning of the overcap will operate to unscrew the closure from the container neck. If, on the other hand, an insufficient force is applied, flange portions 28 will slide along sides 42 and across top surfaces 40. This sliding motion will, of course, be accompanied by axial displacement of the overcap from the inner cap as flange portions 28 slide up the inclined surfaces of sides 42. The difference in length between skirt 36 of inner cap 32 and skirt 18 of overcap 14 allows this axial displacement to occur as successive louvers 20 of overcap 14 slide over successive teeth 38 of inner cap 32 without imparting a turning movement to the inner cap.

The magnitude of the removing force required to produce the camming necessary to impart a turning movement to the inner cap upon rotation of the overcap in the closure-removing direction depends on the materials of which the closure is cnstructed as well as on the angle of inclination of sides 42 of teeth 38 of the inner cap. In order to provide an effective safety closure that resists opening by a small child, it has been found desirable to require the application of a downwardly directed removing force of at least 5.0 pounds. In order to insure that the closure can be opened by most adults, it has been found desirable to limit the removing force required to 8.0 pounds or less.

An exemplary closure in accordance with the preferred embodiment illustrated in the drawings was constructed having an inner cap of polypropylene and an overcap of 0.09 inch gauge CH14-H19 aluminum alloy sheet. A 6.5 pound removing force was selected as optimal for this closure. In order to provide such a removing force requirement, it was calculated that the angle of inclination of sides 42 of the teeth of the inner cap should be about 55°. In order to provide strength to the teeth, the inner cap was constructed with a tooth top surface width of 0.020 inch. This closure was found to exhibit the desired safety characteristics and to serve as an effective closure that was relatively easily operable by adults.

It should be understood that the above description of the present invention is susceptible to various modifications, changes and adaptations, and the same are intended to be comprehended within the meaning and range of equivalents of the appended claims.

What is claimed is:

1. A safety closure for a container having a threaded neck, said closure adapted to be screwed onto said neck for sealing the container and unscrewed therefrom to provide access to the contents of the container, said closure comprising: an inner cap having a top wall with a depending skirt therearound, a plurality of teeth on the top wall, and internal threads for cooperatively engaging with the threaded neck of the container; and an overcap of thin sheet metal having a top wall with a depending skirt therearound, a plurality of louvers in the top wall, each of which comprises a flange portion projecting downwardly at an angle from said top wall and terminating in a terminal edge which is defined by a slit in the top wall and an integral supporting arch portion connecting each side of the flange portion to the top wall between the terminal edge and the junction of the flange portion and the top wall, said louvers being adapted for cooperative engagement with the teeth of the inner cap; said overcap overlying and being loosely mounted on the inner cap whereby a downwardly directed minimal force may be applied to the overcap while turning it in the closure-applying direction to engage the louvers of the overcap with the teeth of the inner cap and thereby screw the closure onto the container neck, and whereby a downwardly directed removing force must be applied to the overcap while turning it in the closure-removing direction to engage the louvers of the overcap with the teeth of the inner cap and thereby unscrew the closure from the container neck.

2. The closure of claim 1 wherein the teeth of the inner cap and the louvers of the overcap are arranged in a circular configuration.

3. The closure of claim 1 wherein the metal of the overcap is CH14-H19 aluminum alloy.

4. The closure of claim 1 wherein the teeth of the inner cap are each generally trapezoidal in cross-section with the top surface of each such tooth being generally parallel to the plane of the inner cap top wall.

5. The closure of claim 4 wherein the top surface of each tooth has a width of about 0.020 inch.

6. The closure of claim 4 wherein one of the non-parallel sides of the cross-section is generally perpendicular to the plane of the top wall, and the other non-parallel side is inclined at an angle of about 55° to the plane of the top wall.

* * * * *